US008220960B2

(12) United States Patent
Long et al.

(10) Patent No.: US 8,220,960 B2
(45) Date of Patent: Jul. 17, 2012

(54) LED LAMP

(75) Inventors: Bin Long, Shenzhen (CN); Guang Yu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 375 days.

(21) Appl. No.: 12/534,803

(22) Filed: Aug. 3, 2009

(65) Prior Publication Data

US 2010/0246179 A1 Sep. 30, 2010

(30) Foreign Application Priority Data

Mar. 31, 2009 (CN) ..... 200910301250

(51) Int. Cl.
*F21S 4/00* (2006.01)
*F21V 21/00* (2006.01)

(52) U.S. Cl. ..... 362/249.02; 362/218; 362/294

(58) Field of Classification Search ..... 362/249.02, 362/800, 555, 152, 153.1, 153, 184, 185, 362/190, 217.01, 218, 217.1–217.17, 230, 362/231, 249.01, 310, 311.02, 373, 431, 362/580, 547, 345, 241, 243, 342
See application file for complete search history.

(56) References Cited

U.S. PATENT DOCUMENTS

| | | | | |
|---|---|---|---|---|
| 7,420,811 | B2 * | 9/2008 | Chan | 361/709 |
| 7,744,247 | B2 * | 6/2010 | Zhang et al. | 362/249.02 |
| 7,762,690 | B2 * | 7/2010 | Li et al. | 362/294 |
| 7,789,528 | B2 * | 9/2010 | Mo et al. | 362/249.02 |
| 7,794,116 | B2 * | 9/2010 | Shuai et al. | 362/294 |
| 7,878,687 | B2 * | 2/2011 | Chen | 362/294 |
| 7,980,725 | B2 * | 7/2011 | Yu et al. | 362/218 |
| 2001/0030866 | A1 * | 10/2001 | Hochstein | 362/294 |
| 2006/0250803 | A1 * | 11/2006 | Chen | 362/373 |
| 2007/0081338 | A1 * | 4/2007 | Kuan | 362/294 |
| 2008/0158888 | A1 * | 7/2008 | Chen | 362/294 |
| 2009/0168416 | A1 * | 7/2009 | Zhang et al. | 362/234 |
| 2009/0237925 | A1 * | 9/2009 | Chao et al. | 362/231 |
| 2010/0008094 | A1 * | 1/2010 | Shuai et al. | 362/373 |
| 2010/0027262 | A1 * | 2/2010 | Shuai et al. | 362/249.05 |

FOREIGN PATENT DOCUMENTS

CN 201184517 Y 1/2009

* cited by examiner

*Primary Examiner* — Anabel Ton
*Assistant Examiner* — Danielle Allen
(74) *Attorney, Agent, or Firm* — Altis Law Group, Inc.

(57) ABSTRACT

An LED lamp includes a lamp body having a heat sink forming an insert and a lamp holder which is connected to the heat sink of the lamp body. The lamp holder includes a mounting portion extending outwards from an external surface thereof. The mounting portion defines a socket. The insert is inserted into the socket to thereby connect the lamp body with the heat sink of the lamp holder. An light source module consisting of a plurality of LEDs is mounted on a bottom surface of the heat sink.

20 Claims, 5 Drawing Sheets

LED LAMP

BACKGROUND

1. Technical Field

The disclosure relates to an LED lamp and, more particularly, to an LED lamp having a low manufacturing cost.

2. Description of Related Art

Generally, a most commonly used lamp includes a lamp body and a lamp holder for connecting the lamp body with a lamp post. The lamp body includes a frame receiving a light-emitting element therein. Both the frame and the lamp holder are integrally formed by a die-casting. When a structure size of one of both the frame and the lamp holder needs to be changed, it is inescapable to redesign a whole die-casting die, including a part corresponding to the frame and the other part corresponding to the lamp holder, that brings a higher die-casting die cost consumption and a waste of design cost.

What is needed, therefore, is a lamp having a lower cost burden including die-casting die cost and design cost.

BRIEF DESCRIPTION OF THE DRAWINGS

Many aspects of the disclosure can be better understood with reference to the following drawings. The components in the drawings are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
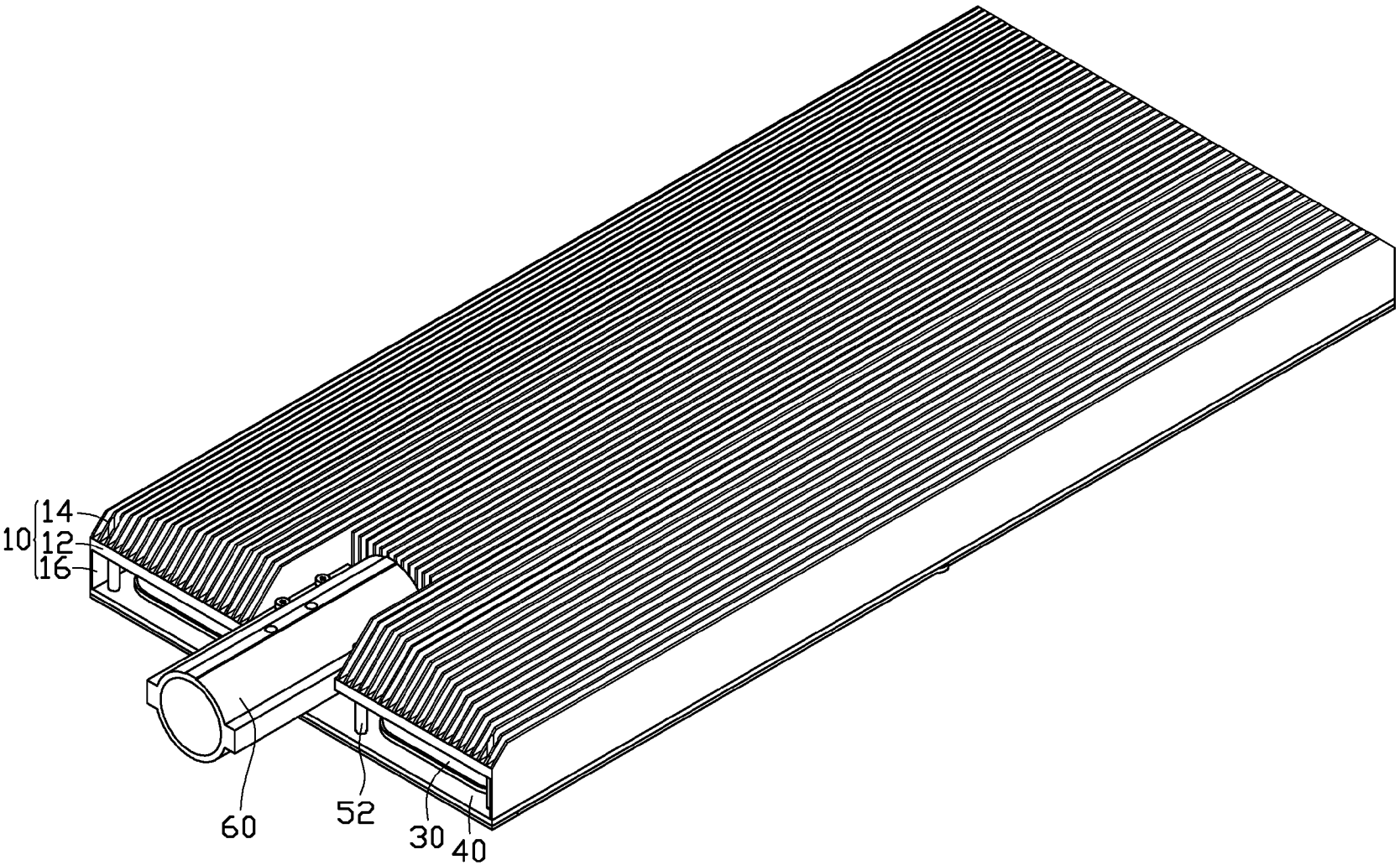
FIG. 1 is an isometric, assembled view of an LED lamp in accordance with an embodiment of the disclosure.
Figure 2:
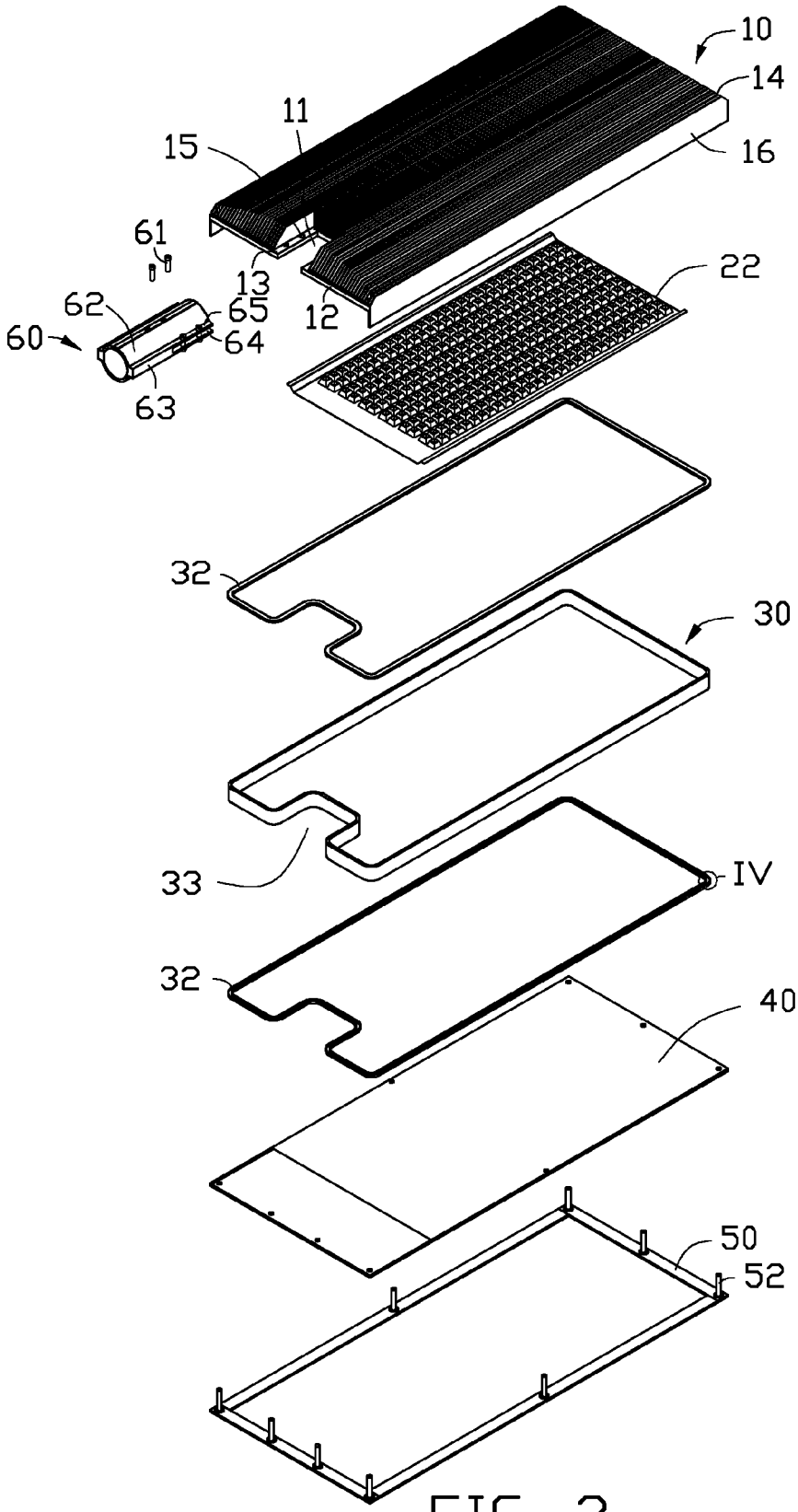
FIG. 2 is an isometric, exploded view of the LED lamp in FIG. 1.
Figure 3:
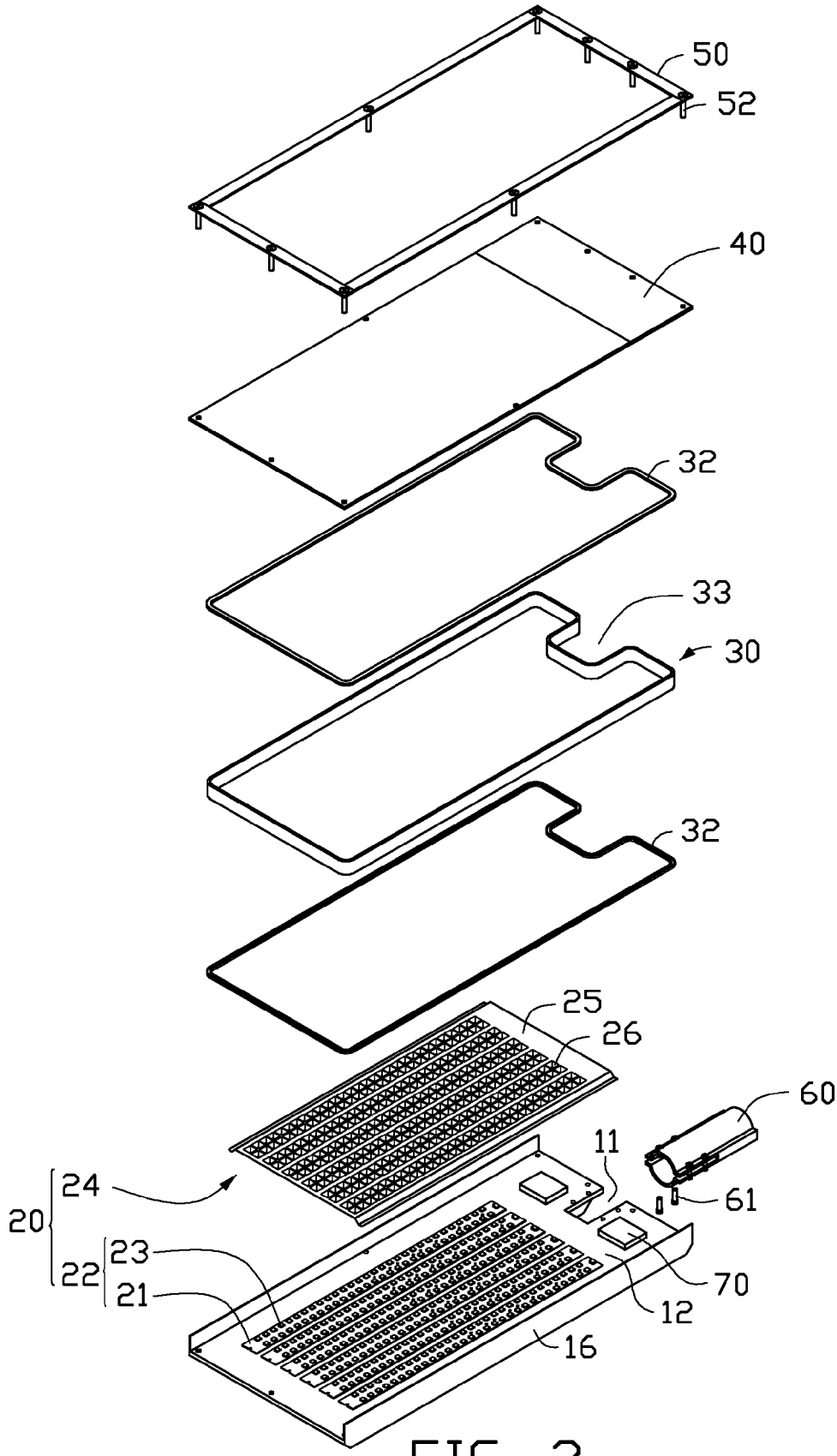
FIG. 3 is an inverted view of the LED lamp in FIG. 2.

Referring to FIGS. 1-3, an LED lamp in accordance with an embodiment of the disclosure includes a lamp body (not labeled) and a lamp holder 60 for connecting the lamp body to a lamp post (not shown). The lamp body includes a heat sink 10, a light source module 20, a frame 30, a plate 40 and a pressing cover 50. The light source module 20, the frame 30, the plate 40 and the pressing cover 50 are disposed at a bottom side of the heat sink 10. The light source module 20 is attached to a middle portion of the bottom side of the heat sink 10. The frame 30 is disposed at a peripheral edge of the heat sink 10 and encloses the light source module 20. The plate 40 abuts the frame 30 and covers the light source module 20. The pressing cover 50 presses on a peripheral edge of the plate 40 and is mounted on the heat sink 10 by a plurality of screws 52. The plate 40, the frame 30, and the heat sink 10 cooperatively form a receiving space for receiving the light source module 20 therein.

The heat sink 10 is integrally formed by aluminum extrusion. The heat sink 10 includes a rectangular flat base 12 having a cutout 11 defined at a middle portion of a front end thereof, a plurality of parallel spaced fins 14 extending upwardly from a top face of the base 12 and two rectangular supporting boards 16 extending downwardly from two opposite long edges of the base 12. The fins 14 are parallel to the supporting boards 16. Two outmost fins 14 of the heat sink 10 each are coplanar with the supporting boards 16, respectively. Heights of the fins 14 gradually increase from two opposite lateral sides of the base 12 to a center of the base 12. None fin is formed on the top face of the base 12 at locations adjacent to two opposite lateral sides of the cutout 11, whereby the base 12 forms two strip-like inserts 13 adjacent to the cutout 11 for inserting into the lamp holder 60. Each insert 13 defines a plurality of through holes 15 for extension of a plurality of fasteners 61 therethrough. Two driving circuit boards 70 are mounted at a bottom face of the base 12 near the two opposite lateral sides of the cutout 11 to electrically connect the light source module 20. In other embodiments, the LED lamp may have only one driving circuit board 70 near a lateral side of the cutout 11.

The light source module 20 includes a plurality of light-emitting modules 22 attached to a middle portion of the bottom face of the base 12 of the heat sink 10 and a reflector 24 covering the light-emitting modules 22. The light-emitting modules 22 are LED modules 22. In this embodiment, each of the LED modules 22 includes a rectangular printed circuit board 21 and a plurality of LEDs 23 attached to a bottom face of the printed circuit board 21. The reflector 24 is mounted on the bottom face of the base 12 to reflect light emitted from the LEDs 23. The reflector 24, substantially rectangular, includes a flat main body 25 and a plurality of funnel-like light-reflecting units 26 recessed upwards from a bottom face of the main body 25. The LEDs 23 are corresponding to the light-reflecting units 26 and respectively received in corresponding light-reflecting units 26. The light-reflecting units 26 reflect light emitted from the LEDs 23 and project light toward a bottom of the lamp body.

Figure 4:
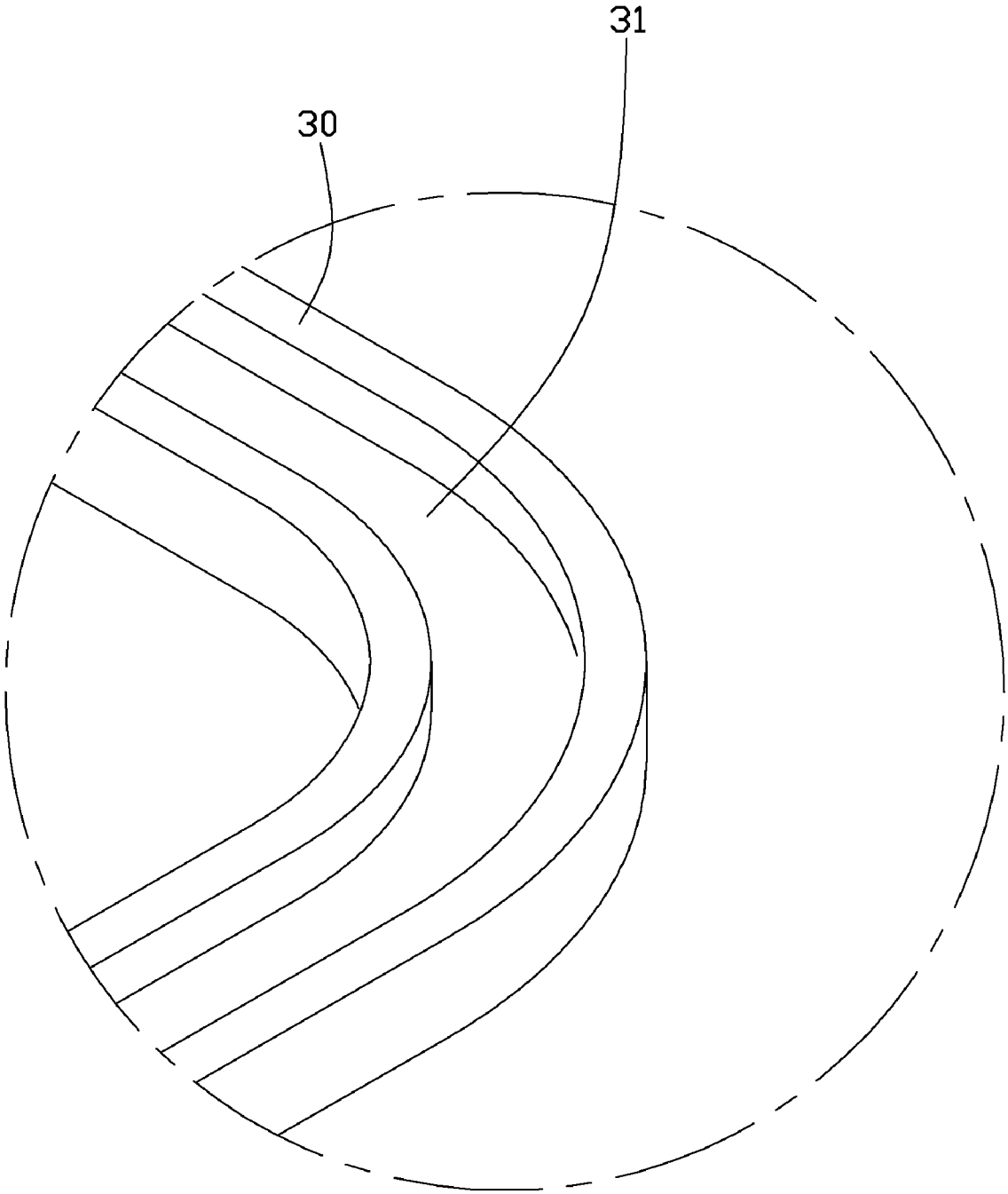
FIG. 4 is a partially enlarged view of a waterproof pad of the LED lamp, taken from a circle IV in FIG. 2.

The frame 30 is formed by a strip having a uniform height and extending around an inner space. A profile of the frame 30 is similar to that of an outer periphery of the base 12 of the heat sink 10. A middle portion of a front end of the frame 30 extends inwardly to define a notch 33 corresponding to the cutout 11 of the base 12. The frame 30 is disposed at a peripheral edge of the base 12 and spaces a certain distance from the supporting boards 16 to define a blank region therebetween for extension of the screws 52 into threaded holes (not labeled) defined in the base 12. Upper and lower waterproof pads 32 which have a similar structure are respectively mounted on top and bottom sides of the frame 30. Referring to FIG. 4, the lower waterproof pad 32 has a top portion recessed downwards to form a groove 31 for receiving a corresponding bottom side of the frame 30 therein. The upper waterproof pad 32 has a bottom portion recessed upwardly to form a groove 31 for receiving a corresponding top side of the frame 30 therein. Each waterproof pad 32 is made of elastomeric material such as rubber, silicone resin and so on. In other embodiments, the base 12 of the heat sink 10 may define a groove (not shown) in the bottom thereof to receive the upper waterproof pad 32 and the top side of the frame 30 therein so that the frame 30 can be prepositioned onto the base 12.

The plate 40 is integrally made of transparent or semitransparent materials such as glass, plastic and so on. The plate 40 has a plate-shaped configuration, and is pressed on a corresponding bottom side of the frame 30. The lower waterproof pad 32 is sandwiched between the plate 40 and the bottom side of the frame 30. The plate 40 has a front end corresponding to the cutout 11 of the heat sink 10, which is coated with an opaque material for concealing the cutout 11. The pressing cover 50 is rectangular and annular, and formed by a plurality of (i.e., four) battens having a uniform width. The screws 52 extend through the pressing cover 50 and into the blank region defined between the frame 30 and the supporting boards 16, and further engage into the base 12 of the heat sink 10. Due to the waterproof pads 32, the receiving space cooperatively defined by the plate 40, the frame 30, and the base 12 of the heat sink 10 has a better hermetical effectiveness for preventing foreign matters, such as mist, dust, or rainwater from entering the LED lamp.

Figure 5:
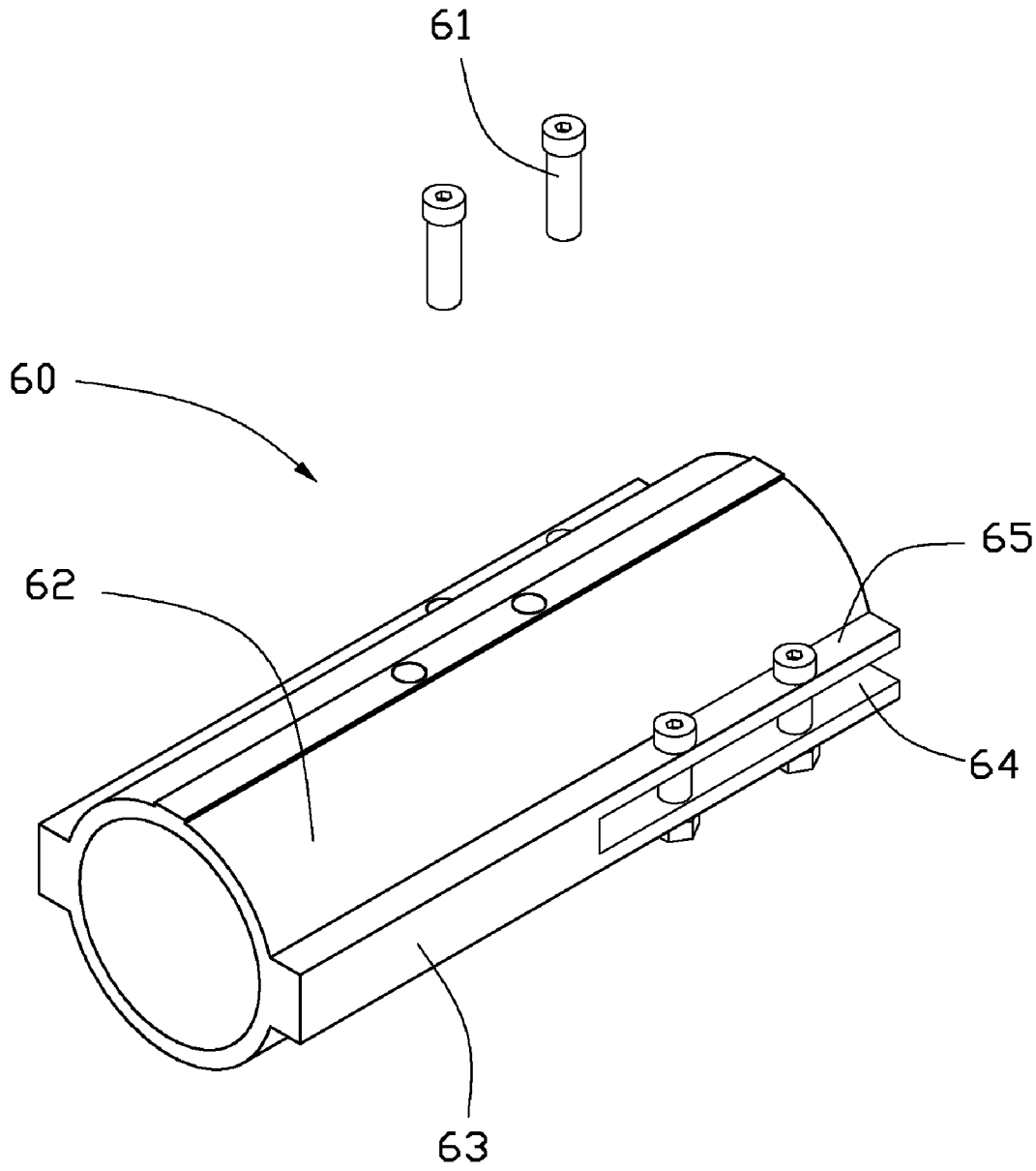
FIG. 5 is an enlarged view of a lamp holder of the LED lamp in FIG. 2, together with a plurality of fasteners.

Referring also to FIG. 5, the lamp holder 60 includes a hollow shell 62 and two mounting portions 63 protruding outwards from two opposite sides of the shell 62. The hollow shell 62 is columnar. Each of the mounting portions 63 defines a socket 64 near a rear end thereof extending along an axial direction of the shell 62 for receiving a corresponding insert 13 of the heat sink 10 therein. A height of the socket 64 is identical to a thickness of the corresponding insert 13. Each mounting portion 63 has two latching portions 65, and the socket 64 is defined between the latching portions 65. The fasteners 61 extend through the latching portions 65 and the corresponding insert 13 to fasten them together so that the lamp body and the lamp holder 60 are connected together.

The driving circuit boards 70 are respectively mounted on the base 12 of the heat sink 10 and received in the frame 30. The driving circuit boards 70 are located at two opposite lateral sides of the notch 33 of the frame 30. The end of the plate 40 coated with opaque material conceals the driving circuit boards 70 and an end of the lamp holder 60 inserted into the inserts 13 of the heat sink 10. The driving circuit boards 70 are electrically connected with the light-emitting modules 22. Power supply lines (not shown) of the driving circuit boards 70 extend through a hole of the hollow shell 62 to connect with an external power supply.

The lamp holder 60 is connected to the lamp body by inserting the inserts 15 formed by the base 12 of the heat sink 10 into the sockets 64 defined by the lamp holder 60, whereby the connecting structure between the lamp holder 60 and the lamp body is very simple; thus, the LED lamp in accordance with the present disclosure can have a low manufacturing cost.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED (light emitting diode) lamp comprising:
a lamp body comprising a heat sink forming an insert;
a lamp holder being connected to the heat sink of the lamp body, the lamp holder comprising a mounting portion extending outwards from an external surface thereof, the mounting portion defining a socket, the insert being inserted into the socket to thereby connect the heat sink of the lamp body with the lamp holder; and
at least an LED module attached to the heat sink;
wherein a plurality of fasteners extend through the mounting portion and the insert of the heat sink of the lamp body to thereby mount the lamp holder on the heat sink of the lamp body.

2. The LED lamp as claimed in claim 1, wherein the lamp holder comprises a hollow shell, the mounting portion protruding outwards from an external surface of the hollow shell.

3. The LED lamp as claimed in claim 2, wherein the shell of the lamp holder has a columnar configuration.

4. The LED lamp as claimed in claim 2, wherein the mounting portion extends along an axial direction of the shell of the lamp holder.

5. The LED lamp as claimed in claim 4, wherein a length of the mounting portion is identical to that of the shell.

6. The LED lamp as claimed in claim 4, wherein the mounting portion defines the socket near a rear end thereof, the socket extending along the axial direction of the shell.

7. The LED lamp as claimed in claim 6, wherein the lamp holder further comprises another mounting portion, the two mounting portions being symmetrically located at two opposite lateral sides of the shell, the another mounting portion defining a same socket.

8. The LED lamp as claimed in claim 7, wherein heat sink of the lamp body comprises a base, the insert and an additional insert being formed at an end of the base.

9. The LED lamp as claimed in claim 8, wherein the end of the base defines a cutout at a middle portion thereof, the insert and the additional insert being located at two opposite sides of the cutout.

10. The LED lamp as claimed in claim 8, wherein the at least an LED module is attached to a bottom face of the base of the heat sink, the LED lamp further comprising a reflector covering the at least an LED module.

11. The LED lamp as claimed in claim 10 further comprising a frame mounted on a peripheral edge of the base of the heat sink and a plate pressing on a bottom portion of the frame and covering the at least an LED module, the reflector reflecting light emitted from the light-emitting modules to the plate.

12. The LED lamp as claimed in claim 11, wherein the plate, the frame and the base of the heat sink cooperatively form a hermetical space for receiving the at least an LED module therein.

13. An LED (light emitting diode) lamp comprising:
a lamp body comprising a heat sink forming an insert;
a lamp holder being connected to the heat sink of the lamp body, the lamp holder comprising a mounting portion extending outwards from an external surface thereof, the mounting portion defining a socket, the insert being inserted into the socket to thereby connect the heat sink of the lamp body with the lamp holder; and
at least an LED module attached to the heat sink;
wherein the lamp holder comprises a hollow shell, the mounting portion protruding outwards from an external surface of the hollow shell;
wherein the mounting portion extends along an axial direction of the shell of the lamp holder; and
wherein a length of the mounting portion is identical to that of the shell.

14. An LED (light emitting diode) lamp comprising:
a lamp body comprising a heat sink forming an insert;
a lamp holder being connected to the heat sink of the lamp body, the lamp holder comprising a mounting portion extending outwards from an external surface thereof, the mounting portion defining a socket, the insert being inserted into the socket to thereby connect the heat sink of the lamp body with the lamp holder; and
at least an LED module attached to the heat sink;
wherein the lamp holder comprises a hollow shell, the mounting portion protruding outwards from an external surface of the hollow shell;
wherein the mounting portion extends along an axial direction of the shell of the lamp holder; and
wherein the mounting portion defines the socket near a rear end thereof, the socket extending along the axial direction of the shell.

15. The LED lamp as claimed in claim 14, wherein the lamp holder further comprises another mounting portion, the two mounting portions being symmetrically located at two opposite lateral sides of the shell, the another mounting portion defining a same socket.

16. The LED lamp as claimed in claim 15, wherein heat sink of the lamp body comprises a base, the insert and an additional insert being formed at an end of the base.

17. The LED lamp as claimed in claim 16, wherein the end of the base defines a cutout at a middle portion thereof, the insert and the additional insert being located at two opposite sides of the cutout.

18. The LED lamp as claimed in claim 16, wherein the at least an LED module is attached to a bottom face of the base of the heat sink, the LED lamp further comprising a reflector covering the at least an LED module.

19. The LED lamp as claimed in claim 18 further comprising a frame mounted on a peripheral edge of the base of the heat sink and a plate pressing on a bottom portion of the frame and covering the at least an LED module, the reflector reflecting light emitted from the light-emitting modules to the plate.

20. The LED lamp as claimed in claim 19, wherein the plate, the frame and the base of the heat sink cooperatively form a hermetical space for receiving the at least an LED module therein.

* * * * *